US008342116B1

(12) United States Patent
Cardarelli et al.

(10) Patent No.: US 8,342,116 B1
(45) Date of Patent: Jan. 1, 2013

(54) MOORING PENDANT APPARATUS

(76) Inventors: Venanzio Cardarelli, Plymouth, MA (US); Ronald A. Wolf, Plymouth, MA (US)

( * ) Notice: Subject to any disclaimer, the term of this patent is extended or adjusted under 35 U.S.C. 154(b) by 0 days.

(21) Appl. No.: 13/199,248

(22) Filed: Aug. 24, 2011

(51) Int. Cl.
*B63B 21/00* (2006.01)

(52) U.S. Cl. ..... 114/230.26; 114/221 R

(58) Field of Classification Search ..... 114/221 R, 114/230.1, 230.2, 230.3, 230.25; 24/599.1, 24/599.4, 599.6, 600.9; 294/175, 191, 82.19, 294/26

See application file for complete search history.

(56) References Cited

U.S. PATENT DOCUMENTS

| | | | | |
|---|---|---|---|---|
| 653,021 | A | 7/1900 | Hamilton | |
| 4,595,223 | A | 6/1986 | Hawie | |
| 5,243,926 | A | 9/1993 | Wright et al. | |
| 5,301,628 | A | 4/1994 | Daskalides | |
| 5,381,749 | A | 1/1995 | Larson | |
| 5,398,634 | A | 3/1995 | Eagan | |
| 5,538,303 | A | 7/1996 | Dunham | |
| 5,634,421 | A | 6/1997 | Velarde | |
| 6,273,017 | B1 | 8/2001 | Griffin | |
| 6,363,876 | B1 | 4/2002 | Blake | |
| 6,390,009 | B2 | 5/2002 | Brown et al. | |
| 6,450,558 | B1 | 9/2002 | Ringrose | |
| 6,907,645 | B2 * | 6/2005 | Jenson et al. | 24/599.6 |
| 7,089,877 | B1 | 8/2006 | Hay | |
| 7,096,813 | B1 | 8/2006 | Luck | |
| 7,712,804 | B2 | 5/2010 | Leyden et al. | |
| 7,757,360 | B1 | 7/2010 | Hong | |

* cited by examiner

*Primary Examiner* — Edwin Swinehart
(74) *Attorney, Agent, or Firm* — D. Michael Burns

(57) ABSTRACT

A mooring pendant apparatus for releasably coupling and decoupling a boat, the apparatus having a clip comprising hook and ring sections, with an opening therebetween defining a mouth. The ring section consists of a pair of loaded holes and an access of rotation hole. A movable arm is biased such that the mouth is kept closed, and it only opens upon activation by a boater who pulls on a cable causing a functional retractor arm to create a greater force on the movable arm that the force keeping it shut, therein causing it to open. A mooring rope is attached to the apparatus which operates as an extension of the boater's arm, and it can be utilized either by keeping the apparatus on the boat or leaving it connected to the mooring line and also to the mooring ball.

19 Claims, 7 Drawing Sheets

MOORING PENDANT APPARATUS

FIELD OF THE INVENTION

This invention relates to an apparatus for releasably coupling and decoupling a clip as to facilitate mooring a boat. More specifically, the apparatus allows for easier attachment of a mooring line to the bow of a boat.

BACKGROUND OF THE INVENTION

Pleasure boats, such as yachts and small boats, are often moored to either a dock rail or a mooring buoy. The mooring line is tied around the dock rail or through a mooring ring on a buoy. Preferably the mooring line is tied to a ring or eye member that is found on the bow of the boat. Because of the difficulty in securing a mooring rope to a relatively remote eye member, such as one found on the bow of a boat, the boater often omits this procedure and only ties the boat to the cleats on the top surface of the boat. The difficulty created in trying to tie the rope to the buoy ring may be just as hard because the boater must reach down for the buoy and then often must pull it up to tie the line. If the mooring line cannot be pulled up, due to factors such as weight or tension in its anchor line, a second person is usually required. The problem encountered in trying to tie a mooring rope to the ring on the bow of a boat is usually due to the awkward position in which most bow rings are located. Reaching over and trying to reach the bow ring may be very hazardous to a boater, especially in rough waters. An unassisted boater may even find it impossible to moor his boat. It may be especially difficult to attach and detach a tie line to a mooring buoy or a boat bow ring or eyelet, in situations where a boat is not small enough to permit the user to reach down and manually fasten or unfasten the clip which secures the tie line to the mooring buoy or bow ring. Also, tying the mooring line to cleats on the deck of the boat creates chafe which can weaken and eventually cause failure of the mooring line. And, with more boats being built with pop-up or pull-up cleats there is the problem of failure from the constant stress of the mooring line. When the freeboard is large, the boatsman must use a long boat hook or gaff to reach down and snag the mooring line and lift it up to height where he can manually snap or unsnap the clip from the buoy or bow eye member.

Remote control attachment assemblies are commercially available and such assemblies usually comprise a slide member designed to be attached to a conventional elongated boat hook and then retain the hook in an open position. This enables the open hook to engage the eye member of the mooring buoy or bow ring. Such assemblies are often difficult to use. The present invention has found that the type of devices that are generally considered the easiest to operate are those that employ a long rod which may be employed as an extension of the boater's arm and wherein the opening and closing of the clip by a remote means eases the burden of the procedure.

SUMMARY OF THE INVENTION

The present invention overcomes the problems outlined above and provides a safe and convenient clip for docking a boat to a mooring structure with the aid of a pendant mooring apparatus. The apparatus releasably couples or decouples to an eyelet on the bow of the boat or to a buoy. The apparatus includes a clip that may open and close for attachment or release. The clip is formed from a hook and an integral ring section which form an opening or mouth therebetween. There are three holes defined on the perimeter of the ring which also has an open portion in the center. The holes include first and second loaded holes and a movable arm having extended legs that friction fit into the loaded holes by such design and location that the movable arm is biased into a closing position on the clip. There is also an access of rotation hole in the ring section which coordinates with a functional retractor arm to activate the opening and closing of the mouth. The retractor arm includes lower and upper arm sections forming an angular deviation in relationship to each other, and a lever arm that with bias frictionally fits into the access of rotation hole to maintain the retractor arm in a state of rotational torque. The retractor arm is in functional contact with the movable arm and upon activation of a greater force by the boater the mouth of the clip is opened.

An embodiment of the invention employs a central rod having means for connecting a first end to the ring section of the clip and a second end containing a displaced eyelet for fastening of a mooring line. A cable, which has one end attached to the retractor arm and an opposing end attached to a handle, will activate the apparatus upon being pulled such that the clip opens and then will close when the pull on the cable is eased.

One embodiment utilizes a cable guide that is affixed to the central rod for maintaining control and alignment of the cable. A fixed handle is usually used to create a grip for the user.

While many other materials may be used, the clip, central rod and displaced ring of the mooring pendant apparatus are preferably formed out of stainless steel or brass and also may be cast or forged. When not cast the rod is integrally connected to the clip by welding. The cable is preferably formed from aircraft cable in order to cope with the harsh conditions of water and weather. The displaced eyelet may be expanded to include multiple eyelets for attachment of multiple mooring ropes, and may be affixed to the mooring line or may be connected at the time of use, thus keeping it on board the boat as opposed to keeping it connected to the mooring line and mooring ball.

DETAILED DESCRIPTION OF THE INVENTION

Preferred embodiments of the invention will now be described with reference to the Figures. Some terms used in such description and in the appended claims are defined below.

Figure 1:
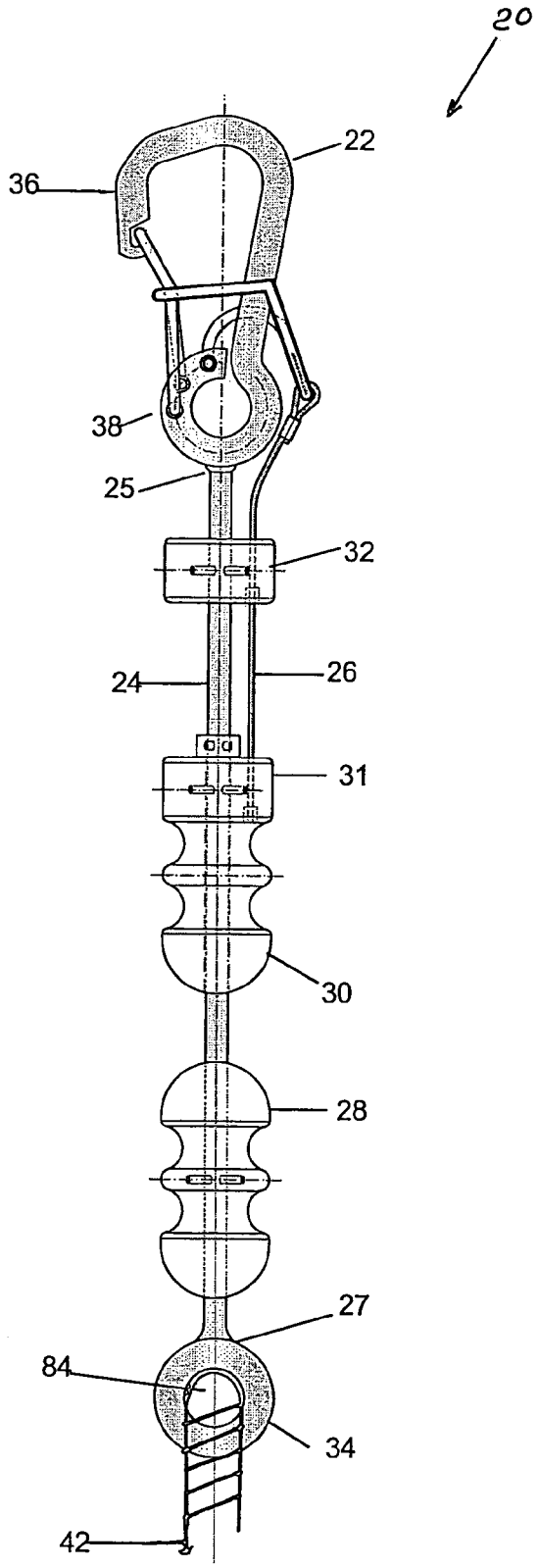
FIG. 1 is an elevational front view of an apparatus for mooring a boat, according to the present invention, and is shown in a closed position.

Referring to FIG. 1, the illustrated mooring pendant apparatus 20 is comprised of the following portions: a clip 22; a central rod 24; a cable 26 that when pulled or released controls the clip 22; handles, both a fixed handle 28, and a movable handle 30; a cable guide 32; and a displaced eyelet 34. The pendant apparatus 20 facilitates the placement and removal of the clip 22 from a boat ring or a mooring ball (not shown). The clip 22 connects to the boat ring and/or to a mooring ball through the medium of a rope for the proper securing of the watercraft while in the water. The boater often keeps the apparatus onboard and connects to the mooring line at the time of use. The apparatus 20 aids the boater in attaching the clip to the boat ring/eyelet that is located on the bow of the boat, which often is a very difficult place to reach. The design and location of boat rings were carefully engineered for function, therein they are usually placed for an attachment which is closer to the surface of the water, which inherently reducing stress by lowering the center of gravity and rotation and by utilization of the framework of the boat to handle stress. The use of the present invention not only helps the boater with the ease of placement and removal of the clip 22 but also aids in the proper stabilization of the boat when moored.

The present invention alters one of the more common commercially available clips and employs it in a most novel manner. As best illustrated in FIGS. 1, 2, 2*a* and 2*b*, the clip 22 is comprised of: a hook section 36; a ring section 38 having a central opening 40 wherein a mooring line 42 may optionally be tied; a movable arm 44 for opening and closing the mouth of the clip 22; access of rotation hole 46 defined in the ring 38 at a unique site for allowing the axis of rotation of a functional retractor arm 48 that serves as a lever to the movable arm 44. The retractor arm 48 is comprised of: a looped section 50 which is connected to a pull cable 26 (discussed below); lower and upper arm sections 54, 56 forming a variable angular deviation in relationship to each other; a functional contact section 58 for engaging the movable arm 44 into an open or shut position upon activation; and, a variable curved lever arm 60 having at a distal end an extension piece 62 that is frictionally fit with great bias into the axis of rotation hole 46, and therein creates the torque rotation axis for the retractor arm 48. The movable arm 44 of the clip 22 has an upper bridge 64 that is locked by snap-fitting into a hook 66 therein closing the mouth 67 of the clip. The movable arm 44 has a first leg 69 with an insertion piece 68 on the distal end that friction fits into a lower opening 70 in the ring 38, and a second leg 71, which is a little shorter in length than the first and having on its distal end an insertion piece 72 which friction fits into an upper opening 74 in the ring 38. Because of the length of the legs 69, 71, and their positioning into non-concentric holes 70, 74 of the ring 38, the movable arm 44 is placed in a biased position which inherently closes the clip 22. The site for the access of rotation hole 46 was carefully chosen to insure that the clip would not be weakened structurally. The design of the movable arm and the manner it is bent is part of the inventive concept. Such a design allows for the movable arm to be placed under tension resulting in it's natural state of closure. As previously stated, it is preferred that the clip 22 be manufactured from a solid piece of stainless steel, however brass or some other corrosion resistant material may be utilized without compromising the inventive concept.

Figures 2, 2A, 2B:
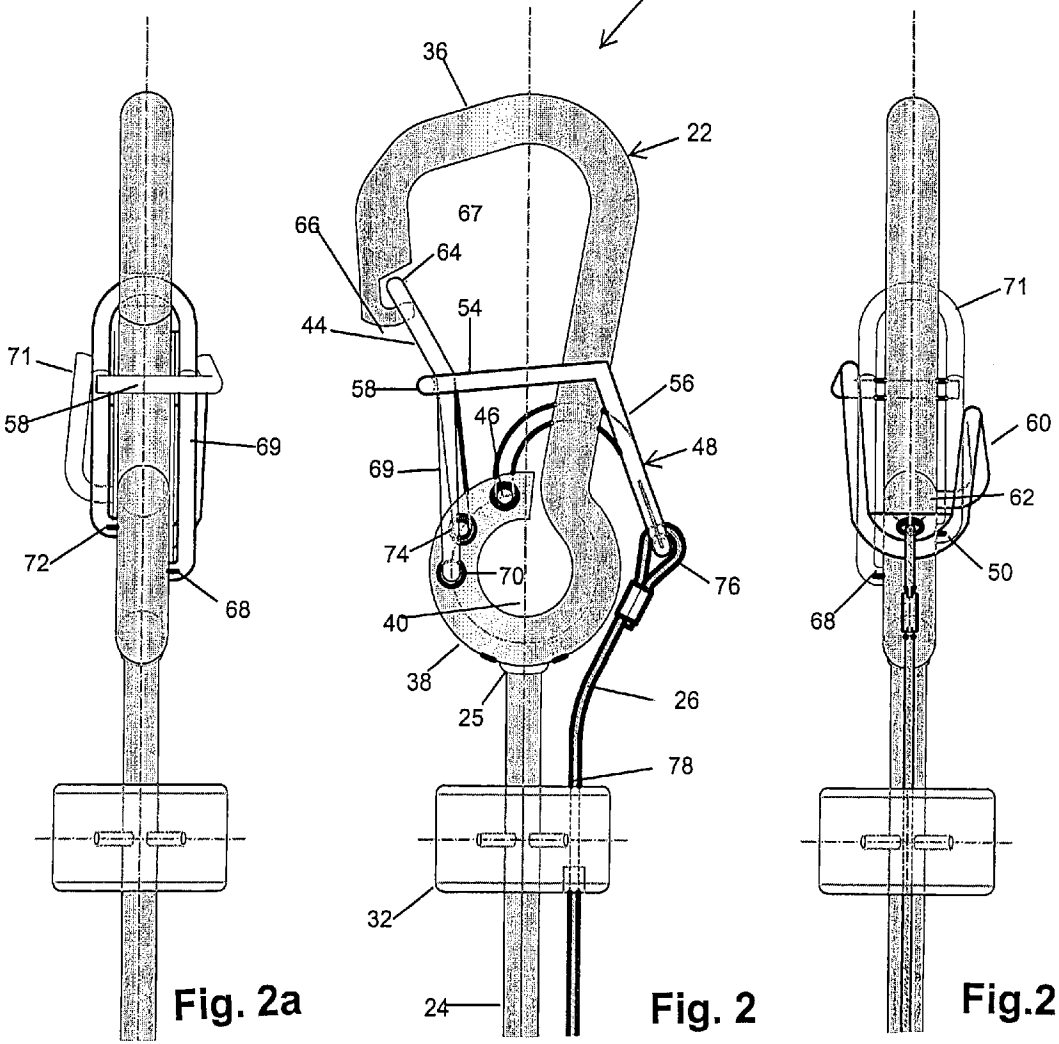
FIG. 2 is an elevational front view of the clip part of the apparatus with the cable guide containing the central rod and cable.
FIG. 2*a* is a left elevational view of FIG. 2.
FIG. 2*b* is a right elevational view of FIG. 2.

A first end 25 of the central rod 24 is permanently attached to the ring 38 by welding, or some other conventional fashion and the rod then extends in succession: through the cable guide 32, then the movable handle 30, and lastly through the fixed handle 28 to a place wherein a second end 27 attaches to a displaced eyelet 34. The eyelet having an opening 84 defined therein for tying a mooring rope/line 42. For securing and controlling the cable 26, a cable guide 32 is provided which is shown in FIG. 2, and in greater detail in 3 and 3*a*. The cable guide 32 should offer the least angulation of the pull from the retractor arm 48. The guide 32 has a beveled conduit 78 for accepting the cable 26 and then minimizing the resistance therein. There is also a channel 80 defined in the center section of the guide for accepting the central rod 24, and multiple threaded holes 82 for insertion of inset screws (conventional screws) to keep the guide attached to the rod.

The mooring line 42 referred to above is usually a strong and sturdy rope. While the instant invention prefers the mooring line to be connected to the displaced eyelet 34, it can also be placed on the ring 38, although when placed on the ring 38 a tight fit is created making it rather difficult to control both the rope and the clip 22. The present invention envisions using the displaced eyelet 34 to affix the mooring line and yet still having the ability to consider the floating of the apparatus when it is not connected to the bow ring on the boat. If the mooring pendant apparatus 20 does not float, then it needs to be placed on or near the mooring ball rather than risk having it sink. When in use the mooring pendant apparatus 20 is connected to the bow ring and serves as an extension of the user's arm. When the mooring line and apparatus 20 are kept in the boat, the connectivity is usually made to the displaced ring 34 and then the boater connects the apparatus 20 to the bow ring. A second line is usually connected to one or more of the cleats on the boat and depending on the length of the central rod 24 the pendant apparatus 20 can be used to retrieve the mooring line 42. The length of the pendant apparatus 20 is a variable based on how much a boater can handle. Since it is an extension of one's arm it is very easy to reach and secure the line to the bow ring, providing it is kept to a reasonable weight.

As described already, the movable arm 44 is the active part of the clip 22, as this is where the tension is created as a result of the design of the length of the legs 69, 71 and their positioning that keep the movable arm biased in the closed position. This is the functional component of the clip, since by pulling the cable 26, the mouth of the clip 22 opens, and by releasing the cable 26, the mouth closes.

The ring 38 section of the clip 22 serves three functions. First, it can house the mooring line, although our preferred housing place as previously stated, is at the displaced eyelet 34 site, secondly because a specific location was chosen on the ring 38 to place an access of rotation hole 46 (the only location which will not possibly effect the integrity of the clip 22, i.e. does not weaken it). The size of the access hole 46 is a function of the size of the retractor arm 48 which is in turn determined by the size of the clip 22. The retractor arm 48 has a curved lever arm 60 with an extension piece 62 inserted into the access hole 46 with great bias. The open ring structure is maintained because it allows for connection to the mooring line, if so desired, and yet still be in contact with the retractor arm 48 for easy opening and closing. If the apparatus is cast, and the ring subsequently is filled solid, such that there is no central opening 40 in the ring 38 to tie the mooring rope, the inventive concept still exists as long as the ring shape was maintained. And thirdly, the importance of the ring structure is that when the remaining two holes on the ring, the lower hole 70 which accommodates the first insertion piece 68 from the distal end of the first leg 69 of the movable arm 44, and the upper hole 74 accommodating a second insertion piece 72 from the shorter second leg 71 of the movable arm, are coordinated and work as designed, a tension is created resulting in the bridge section 64 of the movable arm 44 locking within the hook 66 of the clip 22.

The present invention preferably has the mooring line 42 tied to the displaced eyelet 34. In this design the mooring line is thus displaced away from the clip 22 to avoid the tight spacing if it were tied to the ring 38 on the clip 22, and also so that it cannot interfere with the function of the movable arm 44 or retractor arm 48. This design also displaces the weight of the mooring line to an area further back, thus creating better leverage. While any geometric configuration for the ring may be used, such as a pear shaped design which could offer more room for the mooring line, or a large oval or large triangular form, the line angles must be round to avoid chafing the mooring line when in motion. As previously stated, the displaced eyelet 34 may have a plurality of rings at the end of the rod, therein allowing for more than one mooring line to be connected.

The central rod 24 serves as an extension of one's arm, and may be of any length or diameter or geometric configuration as well. The handles, fixed 28 and movable 30, require a channel 80 to be of a size and shape to accommodate the central rod 24. When a circular cross-sectional rod is used there may be a tendency for the movable handle to rotate on the rod. For this reason a preferred embodiment can have a hexagonal or oval shaped rod, and the rod may also have curvatures. The location of he cable guide 32 limits the rotation.

Figure 3:
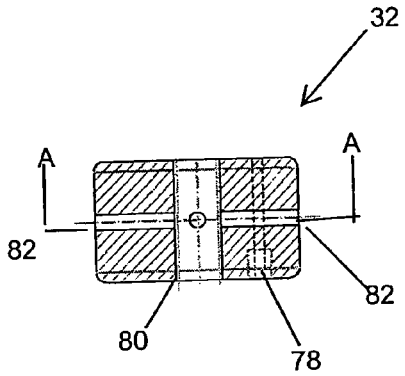
FIG. 3 is a cross-section front view of the cable guide.
Figure 3A:
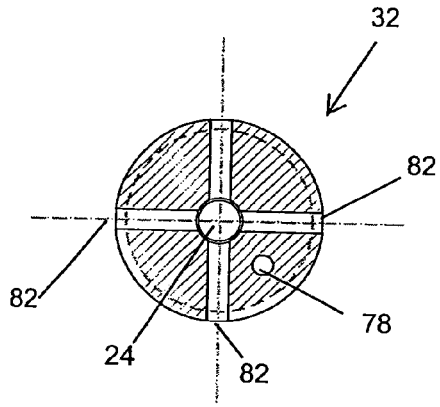
FIG. 3*a* is a cross-sectional top view of the cable guide taken along line A-A of FIG. 3.

The cable 26 is maintained within a cable guide 32 that is illustrated in FIGS. 3 and 3*a*. The cable guide 32 contains the cable from the retractor arm 48 to where it is alongside the rod 24 all while pulling the cable inward and close to the central rod 24, therefore having the most tension placed on it. A conduit 78 at the entrance of the cable guide is beveled to allieviate chafing. The cable enters the guide 32 and exits the guide such that it is held in close alignment with the cental rod 24. In the preferred embodiment the cable is exposed and only covered while in the conduit 78 and has its distal end affixed within the movable handle 30.

The retractor arm 48 forms part of a unique design of the present invention. As previously cited, it has two arm sections, a lower arm section 54 and an upper arm section 56 which are bent in relationship to each other, therefore forming an angular deviation which may be variable. The bending of the retractor arm 48 lowers it such that it is in closer proximity to the rod 24, and the angular deviation is a factor in the exertion necessary for the pull cable 26. The contact section 58 of the retractor arm 48 maintains direct contact with the movable arm 44. This provides the functional aspect of the invention, such that when the cable 26 is pulled, it exerts a rotational force around the axis of rotation within the access hole 46 thereby applying pressure on the movable arm 44 by pulling it backwards to cause it to separate from the hook 66 and thereby open. The reverse of this action is such that upon releasing the pull on the movable handle 30, the cable tension is also lessened hereby closing the clip 22. It is shown on FIGS. 2 and 2*a*, that the contact section 58 embraces both, the longer arm 69 and the shorter arm 71 sections of the movable arm 44 and by pulling on both sections evenly, there is no deviation or deformation caused by an uneven pull. This is best achieved by controlling the angle formed by the upper and lower arm sections 56, 54 of the retractor arm 48. The angular deviation between the arm sections 56, 54 are variable.

The cable 26 can be made of any material having the strength and capability to handle salt water, controlled elongation under wet conditions, as well as the effects of warm or cold temperatures. Materials may include rope or aircraft cable, but any wire, cable or rope may be substituted provided it can cope with the harsh environment without any elongation problems. Aircraft cable is preferred for the present invention and it has shown excellent controlled elongation under wet conditions. If stainless steel is used, it is better if coated so that it is not be abrasive to the system or to the grasp of the user's hands. Lack of elongation is critical as any elongation of the cable would affect the distance in which the movable bar opens and closes, as the distance of the movable handle pull is essentially measured. As stated the cable 26 is attached to the looped section 50 of the retractor arm 48 and is secured with a ferrule clip 76. The cable 26 freely moves through the beveled conduit 78 of the cable guide 32, without hindrance or resistance, and connects to the movable handle 30, wherein it is secured internally. In the present invention, the fixed handle 28 is connected to the rod 24 and the movable handle 30 is positioned at a certain distance above the fixed handle but not secured to the rod 24. The distance between the fixed and movable handles is established by how much the movable handle 30 has to be pulled towards the fixed handle 28 for movable arm 44 to completely open the mouth of the clip. Therefore, it is critical that the cable maintain its length with no elongation allowed.

Figure 4:
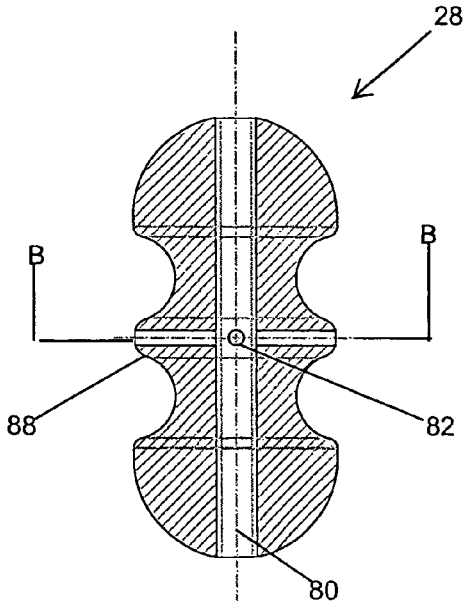
FIG. 4 is a cross-sectional view of the fixed handle of FIG. 1.
Figure 4A:
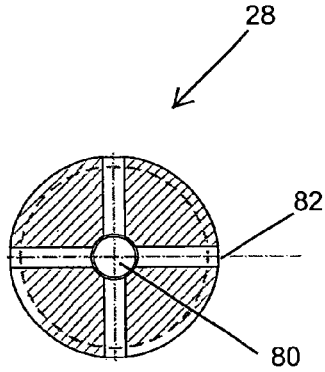
FIG. 4*a* is a cross-sectional view of the fixed handle taken along line B-B of FIG. 4.

As shown in FIGS. 4 and 4*a*, the fixed handle 28 has a central elevated portion 88 which contains four (4) threaded holes 82 for insertion of a like number of inset screws (not shown) which connect the fixed handle 28 to the central rod 24, and they are hidden and non-abrasive to the user. These inset screws preferably will be covered by either rubber or plastic caps to protect them from the elements. Both the fixed, and movable handles 28, 30, and the cable guide 32 were designed such that their convex outermost parts act as bumpers when the hull is in a flax tide, and therein allow the system to come into contact with the bow of the boat. The fixed handle 28 functions to eliminate the need of the user to grasp and pull the movable handle 30 as well as the central rod 24 as a point of fixation. The present invention allows for a finger and hand grasp rather than just a hand grasp that may be not comfortable. Another benefit of the fixed handle 28 is not just the extreme comfort, but it also allows the user to finger hold the clip 22 in the open position and the approach to the bow ring can be approached in different directions and individual preferences. The center channel 80 through the movable handle 30 is slightly larger than the channel defined in the fixed handle 28 or the cable guide 32. This allows it to have an ease of movement on the pull cable as varying temperatures may have an effect on handle materials such as plastics, metals or rubber. It is preferred that the handles and guides be molded in half sections and then joined together around the central rod 24. The fixed handle 28 and the movable handle 30, have the same basic parts, except that the inset screws of the fixed handle 28 secure it to the central rod 24. The movable handle 30 also has an extension 31 in its top side to limit any possible warble of the handle once the pull is initiated. The set screws, as used with both the cable guide 32 and fixed handle 28, have the function of securing each of them to the central rod 24, while the set screws used in the movable handle 30 are mainly utilized for fixating the two halves of the handle and are not to make it integral with the central rod 24.

Figure 5:
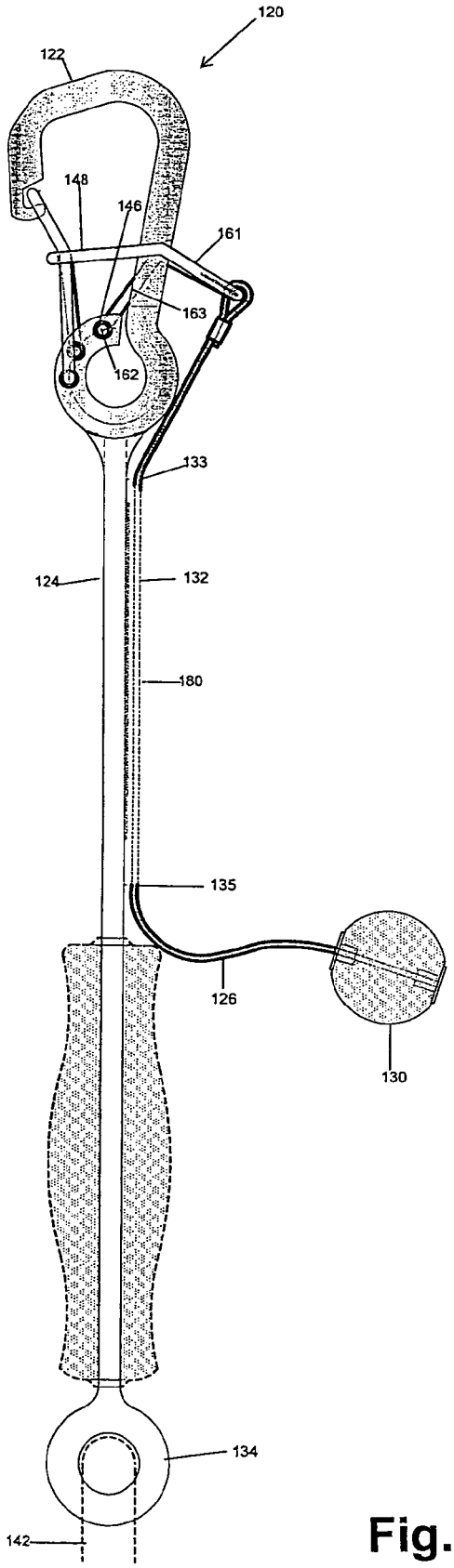
FIG. 5 is an elevational front view of an embodiment of the invention having a mooring ball as a movable handle.

FIG. 5 depicts an alternative mooring pendant apparatus which is referenced as apparatus 120. The clip 122 is the same as shown in the preferred embodiment, but in this embodiment the retractor arm 148 has been altered slightly. The cable guide 32 has been replaced by a longitudinally shaped cable guide 132, and the movable handle 30 has been replaced by a pull ball 130. This alternate embodiment also presents a two sectioned retractor arm 148 but with a less severe angle. It is to be noted that the curved section 60 of FIG. 1 now has two straight sections, an upper section 161 and a lower section 163, with the lower section having an extension piece 162 that is rotatively friction fitted into the access of rotation hole 146. The basic concept of activating the retractor arm 148 does not change with this embodiment as it still provides for a center of rotation through the same access hole 146. This embodiment utilizes a cable guide 132, which in addition to being affixed to the central rod 124, has a more longitudinal tube shape and therein is able to control a greater length of the cable 126 internally through a conduit 180. This conduit 180 is beveled at the upper entrance 133 to reduce stress. The purpose for this embodiment is that if the manufacturing process called for a cast structure, it would be easier to make, especially in eliminating the cable guide and movable handle of the preferred embodiment. The cable guide 132 is herein a singular tube concept which will allow for a pull that is off center yet still a very effective and proper pull. The lower site 135 where the pull cable 126 exits the guide is beveled outwardly. FIG. 5 describes how a pull ball 130 is affixed to the cable 126 and makes it easier for pulling the cable. The pull ball 130 would be preferably made from a plastic or rubber material and convention methods can be used to attach it to the cable 126. The fixed handle 128 is preferably to be plastic or rubber, but could be cast along with the central rod. If plastic is used, it can be friction fitted and affixed with screws as was the fixed handle 28 of the preferred invention. The displaced eyelet 134 maintains the structure of the preferred embodiment and shows a mooring line 142 connected therein. It is to be appreciated that the displaced eyelet 134 could also include a plurality of eyelets for multiple mooring lines. The typical operation of this embodiment would remain as an extension of one's hand, wherein the user takes the device 120 and connects to the mooring line 142 then pulls on the pull ball 130 with his hand simultaneously grasped on either the fixed handle 128 or the rod itself, and with the pull ball 130 grasped in his hand he can operate the opening and closing of the clip. Upon the clip 122 being secured on the bow ring of the boat or the mooring ring, the clip 122 is then closed by releasing tension on the cable 126. When returning to use the boat, the user grabs the ball 130, starts the initial pull and grabs the handle or the rod itself wherein the clip 122 opens and the apparatus is free from the boat ring.

Figure 6:
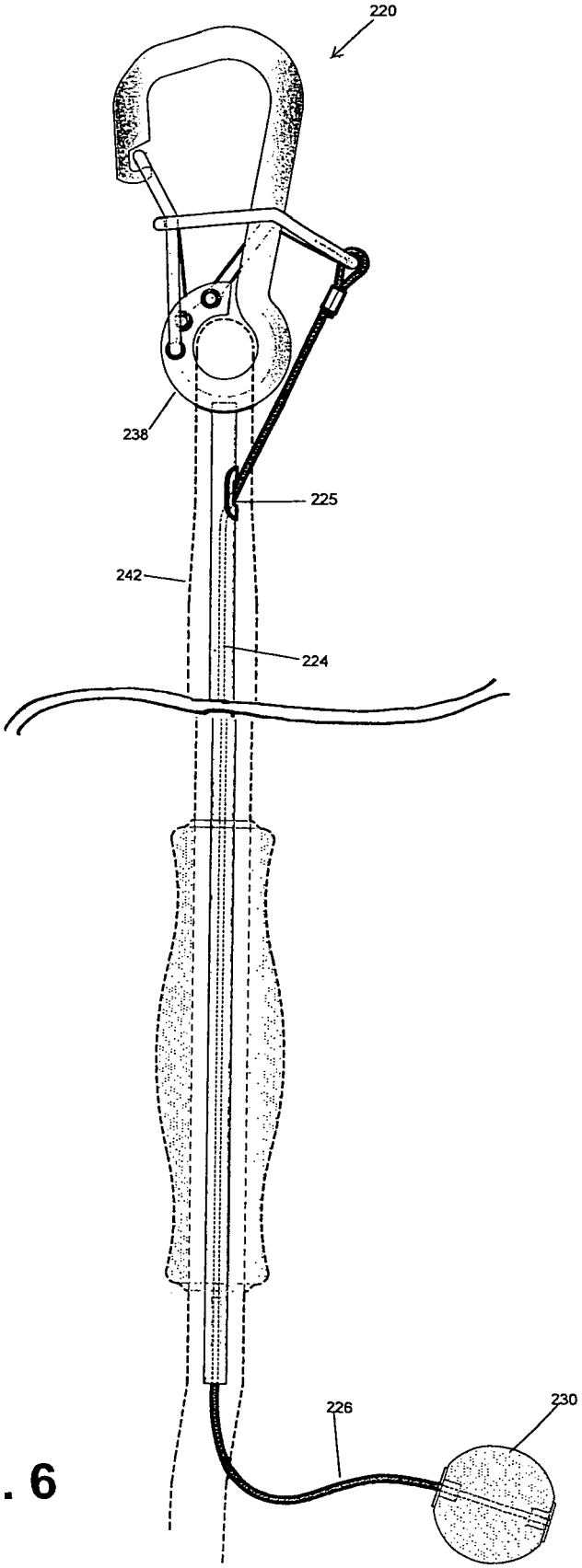
FIG. 6 is an elevational view of another embodiment of the invention depicting an alternate location for the mooring ball and deploying the cable on the inside of the central rod.

Another embodiment 220 of the invention is shown on FIG. 6. The mooring line 242 is shown connected to the ring 238 and not to the displaced eyelet. This is a modification wherein the pull cable 226 is placed into an eyelet opening 225 defined in the central rod 224 that is designed to have the cable 226 pass through the entire length of the rod 224, and whereupon exiting the bottom of the rod, it is then affixed to a pull ball 230. This embodiment adds bulk to the apparatus 220 as the mooring line is added at the ring 238 of the clip. The mooring line effectively becomes a handle and it would not be a critical defect if the cable elong'ated as it could still be adequately operated by the central rod 224. This embodiment would require a flotation device or connection to the mooring ball 230 because of the heavy weight considerations that might cause it to sink. An added benefit of this embodiment is that the boater's vision is enhanced, because he now sees what he is accustomed to seeing which is a mooring rope connected to the boat ring. The rope also makes for a good bumper.

Figure 7:
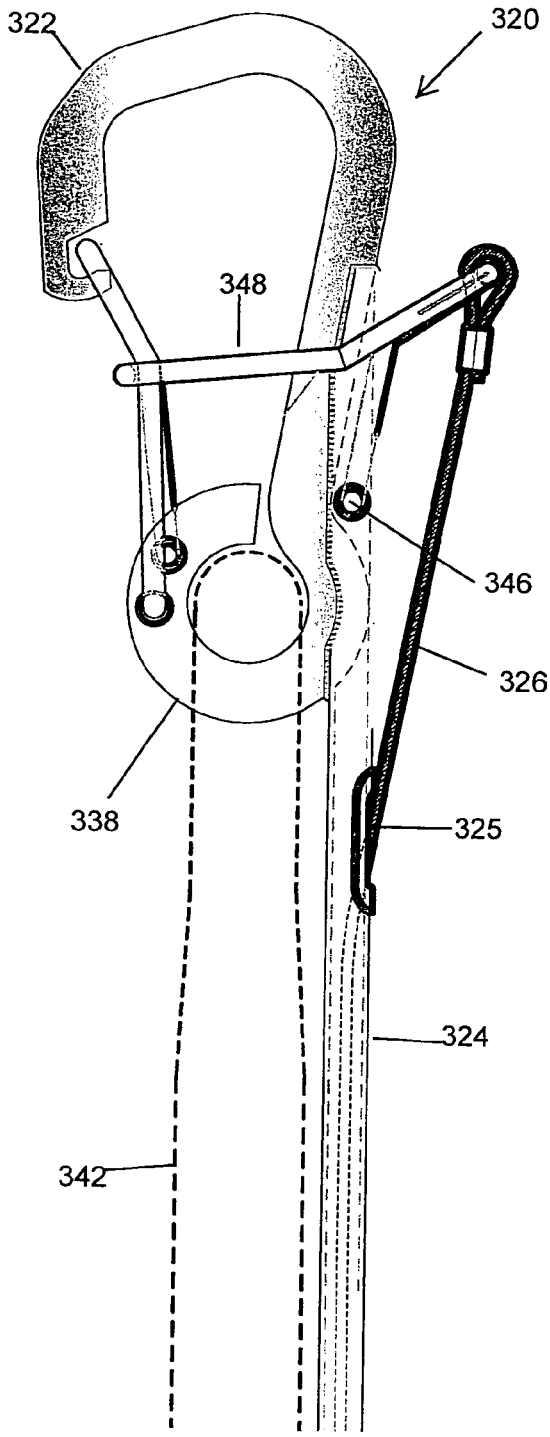
FIG. 7 is a front elevational view of the top portion of another embodiment of the invention.
Figure 7A:
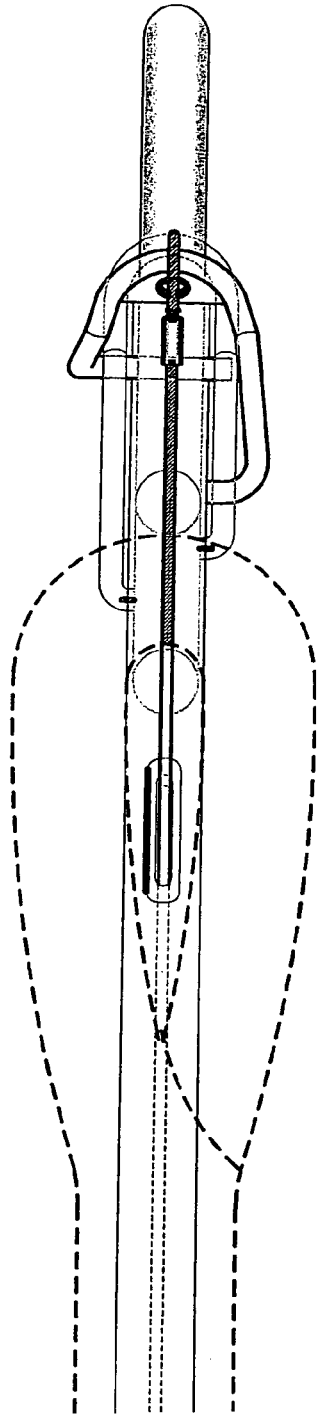
FIG. 7*a* is a left elevational view of FIG. 7.

Another embodiment of the apparatus 320 is shown in FIGS. 7, and 7*a*, wherein the access of rotation hole 346 has been removed from the previous location on the ring 338, and repositioned to an external bar system 324, which is used in lieu of the central rod 24 of the preferred embodiment, This re-design accommodates a retractor arm 348 (now angled upwards and therein altering the pull on the cable). The external bar system 324 provides for access by the cable 326 and has a beveled eyelet 325 whereby the cable enters and passes through the entire remaining bar 324 and exits at the bottom where it is affixed to a pull ball (not shown but previously described). The point of rotation herein is within the external bar system 324, and outside of the mooring line 342 and has an upper end that in addition to housing the access of rotation hole 346, also is affixed to a newly designed clip 322, which connects the external bar 324 to the clip around the ring section and to the back side of the clip. This apparatus can be cast, welded or forged. The section closest to the clip 322 should be semi-lunar or half circular in shape to house the clip's main body including the ring structure. It is also anticipated that a variant of this embodiment of the invention could also house the access hole 346 in the ring as described previously in the preferred invention. The cable 326 can be connected to a ball as previously described.

Figure 8:
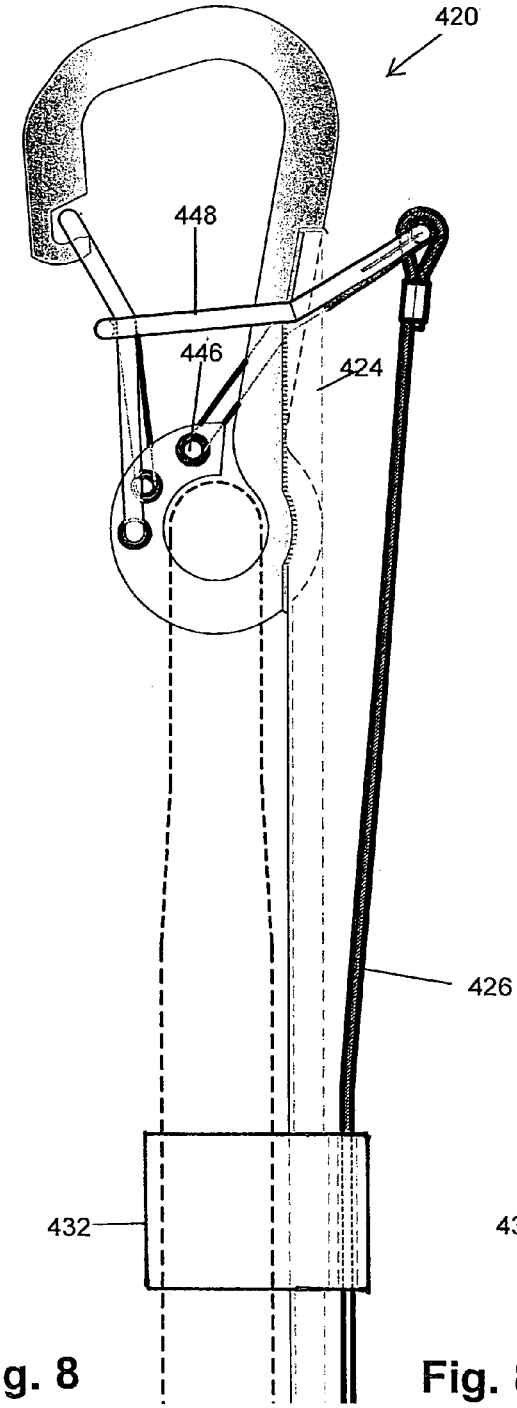
FIG. 8 is a front elevational view of the top portion of another embodiment of the invention.
Figure 8A:
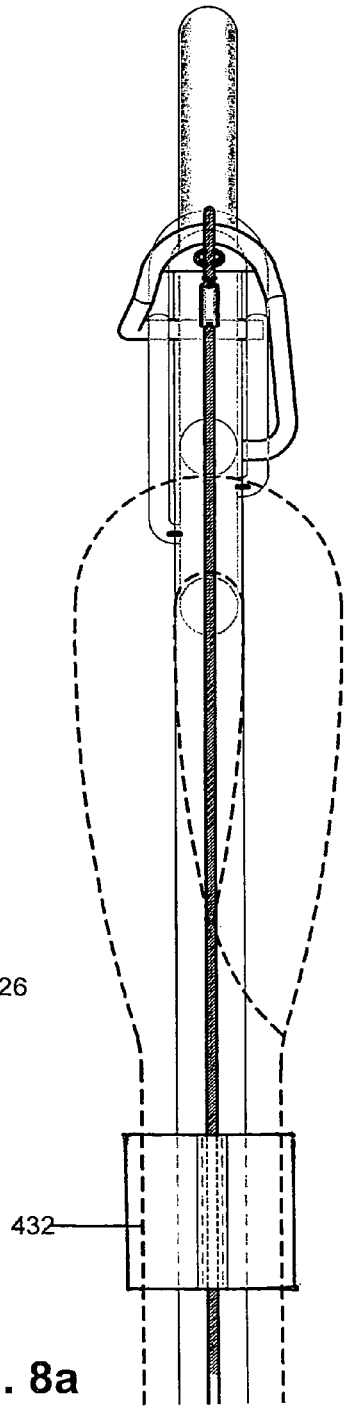
FIG. 8*a* is a right elevational view of FIG. 8.

A final embodiment of the invention 420, shown on FIGS. 8 and 8*a*, also uses an upward angulation of the retractor 448 as previously discussed, and also an external rod system 424, but still utilizes the original location of the preferred embodiment for the access of rotation hole 446 on the ring. This apparatus shows a structure operating with a triple function cable guide 432 to hold not just the mooring line/rope 424, but also the cable 426 and external bar 424. The cable guide 432 is sectional rather than providing a full length unit.

While it is apparent that the illustrative embodiments of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention. It is anticipated that the apparatus has a variety of uses outside of watercraft uses.

What is claimed is:

1. A mooring pendant apparatus for use in docking a boat, wherein the apparatus releasably couples or decouples to an eyelet on the bow of the boat or to a buoy, or to a dock, the apparatus comprises:

a clip having:

a hook section integral with a ring section, with an opening therebetween defining a mouth;

the ring section consisting of three holes defined on an outer perimeter, a first loaded hole and a second loaded hole, and an access of rotation hole; and a movable arm for opening and closing the mouth of the clip, the arm having a first leg with an insertion piece on a distal end that biasly fits into the first loaded hole and a shorter second leg with an insertion piece on a distal end that biasly fits into the second loaded hole, both legs by the design of the legs and their hole locations, cause an upper bridge section of the movable arm to be biased into a closed position with the body of the clip;

a functional retractor arm having: lower and upper arm sections forming an angular deviation in relationship to each other; an engagement section that is in functional contact with the first and second legs of the movable arm; a lever arm having an extension piece that is biasly fitted into the access of rotation hole to maintain the retractor arm in a state of rotational torque; and a looped section;

a central rod having means for connecting a first end to the ring section of the clip;

a cable for activation of the apparatus having means for fastening one end to the looped section of the retractor arm;

a cable guide for maintaining control of the cable passing through it;

a fixed handle attached to the central rod; and a movable handle securely holding the other end of the cable, wherein a boater may activate the apparatus by pulling on the movable handle to apply a pulling force on the cable therein activating the engagement section of the functional retractor arm with a force to overcome the bias on the movable arm therein opening the mouth of the clip, which may be closed by releasing the pull on the cable.

2. The apparatus of claim 1, wherein the central rod has a second end containing a displaced eyelet for fastening of a mooring rope.

3. The apparatus of claim 2, wherein the clip, functional retractor arm, central rod and displaced eyelet are formed out of stainless steel or brass.

4. The apparatus of claim 2, wherein the clip, functional retractor arm, central rod and displaced eyelet are formed by casting.

5. The apparatus of claim 2, wherein the clip, functional retractor arm, central rod and displaced eyelet are formed by forging.

6. The apparatus of claim 1, wherein the connecting means for the rod to the clip ring and displaced eyelet is by welding.

7. The apparatus of claim 1, wherein the cable is formed from aircraft cable.

8. The apparatus of claim 2, wherein the lever arm is curved, the cable guide having a beveled conduit defined therein for accepting the cable, a channel defined through the center of the guide for passage of the central rod, and the movable handle is a plastic or rubber and upon being pulled activates the apparatus.

9. The apparatus of claim 7, wherein the lever arm comprises: two straight sections forming an angle therebetween; the cable guide is longitudinally shaped and attached entirely to the central rod, and the movable handle is a pull ball that when pulled causes the apparatus to be activated.

10. The apparatus of claim 1, wherein the apparatus comprises: the mooring rope attached to the ring section; the lever arm having two straight sections forming an angle therebetween; the cable guide being a channel within and extending through the entire length of the central rod; and, the movable handle is a pull ball attached to the cable at the other end of the central rod, that when pulled by a user causes the apparatus to be activated.

11. A mooring pendant apparatus for use in docking a boat, wherein the apparatus releasably couples or decouples to an eyelet on the bow of the boat or to a buoy, or to a dock, the apparatus comprises:

a clip having:

a hook section integral with a ring section, with an opening therebetween defining a mouth;

the ring section having an opening in the central portion for attachment of a mooring rope, and first and second loaded holes and an access of rotation hole on a perimeter of the ring section;

a movable arm for opening and closing the mouth of the clip, the arm having a first leg with an insertion piece on a distal end that biasly fits into the first loaded hole and a shorter second leg with an insertion piece on a distal end that biasly fits into the second loaded hole, and by a function of the design of the legs and their hole locations, an upper bridge section of the movable arm is biased into a closed position with the body of the clip;

a central rod having means for connecting a first end to both, the hook and ring sections of the clip, the central rod having an access of rotation hole near its upper end, and a channel extending through a lower portion of the rod to act as a cable guide;

a functional retractor arm having: lower and upper arm sections forming an angular deviation in relationship to each other; an engagement section that is in functional contact with the first and second legs of the movable arm; a lever arm having an extension piece that is biasly fitted into the access of rotation hole to maintain the retractor arm in a constant state of torque; and, a looped section;

a cable having one end fastened to the looped section of the retractor arm, the substantial length of the cable passing through the channel in the rod, and exiting the other end of the rod;

a movable handle securely holding the other end of the cable, wherein a boater may activate the apparatus by holding the mooring rope and/or rod and pulling on the movable handle to cause the cable to activate the engagement section of the retractor arm with a force to overcome the bias on the movable arm therein opening the mouth of the clip, wherein the boater may close the mouth by releasing the pull on the cable.

12. The apparatus of claim 11, wherein the clip, functional retractor arm, and central rod and displaced eyelet are formed by casting.

13. The apparatus of claim 11, wherein the clip, functional retractor arm, central rod and displaced eyelet are formed by forging.

14. The apparatus of claim 11, wherein the connecting means for the rod to the clip ring and hook section is by welding.

15. The apparatus of claim 11, wherein the cable is formed from aircraft cable.

16. A mooring pendant apparatus for use in docking a boat, wherein the apparatus releasably couples or decouples to an eyelet on the bow of the boat or to a buoy, or to a dock, the apparatus comprises:

a clip having:

a hook section integral with a ring section, with an opening therebetween defining a mouth;

the ring section having an opening in the central portion for attachment of a mooring rope, and three holes defined on an outer perimeter, a first loaded hole, a second loaded hole, and an access of rotation hole; and a movable arm for opening and closing the mouth of the clip, the arm having a first leg with an insertion piece on a distal end that biasly fits into the first loaded hole and a shorter second leg with an insertion piece on a distal end that biasly fits into the second loaded hole, wherein the design and positioning of the legs creates an upper bridge section to be biased against a hook on the clip to effectively close the clip;

a functional retractor arm having: first and second arm sections forming an angular deviation in relationship to each other; an engagement section that is in functional contact with the first and second legs of the movable arm; a lever arm having an extension piece that is biasly fitted into the access of rotation hole to maintain the retractor arm in a constant state of torque; and a looped section;

a central rod having means for connecting a first end to both, the hook and ring sections of the clip, a cable for activation of the apparatus having means for fastening one end to the looped section of the retractor arm and the other end to a pull ball; and a triple function cable guide having a mooring hole for maintaining control of the mooring rope, a channel for maintaining the central rod therein and a conduit for maintaining the passage of the cable line through it, wherein a boater may activate the apparatus by pulling on the pull ball to cause the cable to activate the engagement section of the retractor arm with a force to overcome the bias on the movable arm therein opening the mouth of the clip, and closing the mouth by releasing the pull on the cable.

17. The apparatus of claim 16, wherein the clip, retractor arm and central rod are cast.

18. The apparatus of claim 16, wherein the clip, retractor arm and central rod are forged.

19. The apparatus of claim 16, wherein the connecting means for the rod to the clip ring and hook section is by welding.

* * * * *